US006866582B2

(12) United States Patent
Watanabe et al.

(10) Patent No.: US 6,866,582 B2
(45) Date of Patent: Mar. 15, 2005

(54) DISPLAY DEVICE, AND GAME MACHINE

(75) Inventors: Kaoru Watanabe, Tokyo (JP); Takashi Uchiyama, Tokyo (JP); Keiji Fujimori, Tokyo (JP)

(73) Assignee: Konami Corporation, Tokyo (JP)

( * ) Notice: Subject to any disclaimer, the term of this patent is extended or adjusted under 35 U.S.C. 154(b) by 287 days.

(21) Appl. No.: 09/927,259

(22) Filed: Aug. 13, 2001

(65) Prior Publication Data

US 2002/0022513 A1 Feb. 21, 2002

(30) Foreign Application Priority Data

Aug. 11, 2000 (JP) ..... P.2000-244177

(51) Int. Cl.[7] ..... A63F 9/24
(52) U.S. Cl. ..... 463/20; 463/36; 463/30
(58) Field of Search ..... 463/1, 9, 12–13, 463/16–20, 25–26, 30, 36, 40–43; 273/143 R, 292–293, 121 B, 139, 138.2; 700/91–92

(56) References Cited

U.S. PATENT DOCUMENTS 4,508,345 A * 4/1985 Okada
6,110,041 A * 8/2000 Walker
6,186,893 B1 * 2/2001 Walker
6,302,790 B1 * 10/2001 Brossard ..... 463/20

FOREIGN PATENT DOCUMENTS

JP 6-23091 A 2/1994

* cited by examiner

*Primary Examiner*—Mark Sager
(74) *Attorney, Agent, or Firm*—Sughrue Mion, PLLC

(57) ABSTRACT

In a slot machine, when a player actuates a start lever, three reels spin, thereby effecting internal drawing operation and determining a winning combination. When the player actuates stop buttons, predetermined stop control operations are performed. A combination of symbols corresponding to the winning combination are achieved along anyone of winning lines. A plurality of image data sets which can be displayed on a liquid-crystal display (21) are recorded in an image data ROM (44) provided in a liquid-crystal display unit (20) of the slot machine. When the player actuates a changeover switch (23), switch setting information is sent to a CPU (41). An image display LSI (45) reads out from the image data ROM image data corresponding to the setting information, thereby using the thus-read image data for display contents of the liquid-crystal display.

2 Claims, 11 Drawing Sheets

DISPLAY DEVICE, AND GAME MACHINE

BACKGROUND OF THE INVENTION

1. Field of the Invention

The present invention relates to a display device for use in a game machine, in which a plurality of symbols are variably displayed by and on a variable display device, and when a combination of some symbols corresponds to a predetermined combination of symbols along any winning line of the variable display device at the time the variable display is stopped, a bonus, such as tokens etc., is paid to a player. Further, the present invention relates to a game machine equipped with the display device.

The present application is based on Japanese Patent Application No. 2000-244177, which is incorporated herein by reference.

2. Description of the Related Art

A game machine of aforementioned type has hitherto been known as a slot machine. In the slot machine, a plurality of reels, each having a plurality of symbols, serve as variable display devices. All the reels are stopped by way of actuation of stop buttons etc. In the slot machine, when a predetermined combination of symbols, corresponding to a winning combination, is achieved along any winning line, tokens are paid out in accordance with the combination. In general, in the case of such a slot machine, when a player actuates a predetermined start lever, a winning combination drawing device performs internal drawing operation for conducting drawing of an arbitrary winning combination. When a predetermined winning combination has been hit with the internal drawing operation, the reels are controlled to stop such that a combination of symbols corresponding to the winning combination is more likely to arise. Conversely, when no winning combination has been hit with the internal drawing operation, a combination of symbols cannot correspond to any winning combination, regardless of the timing at which the player actuates the stop buttons etc.

Some of such game machines have an indicator such as a liquid-crystal display etc. The indicator displays a stationary or moving image corresponding to the game status of the game machine, thereby warming the game up. Alternatively, the indicator is utilized for informing the player that the player can join a bonus game in accordance with the internal drawing operation.

Operators who run "Pachinko" (Japanese popular game) parlors or amusement arcades using game machines and players of the game machines have been unable to change contents to be displayed on the indicator. Even when the operator desires to eliminate reporting functions of game machines for informing a player that the player can join a bonus game in accordance with the internal drawing operation, removal of the reporting functions has been impossible for reasons of business operation.

The indicator displays contents matching a predetermined theme, thereby providing the contents to players. However, there may be a case where the contents do not match players' preferences. Even in such a case, the players cannot change the contents. Hence, a very small degree of freedom in choosing contents to be displayed on the indicator is available for operators, players, etc., who are users of the game machines.

Game machines, such as slot machines etc., are designed and manufactured under certain standards. However, all types of game machine are substantially identical in terms of an interface, provided in the indicator, for connecting a control section of a game machine to the indicator and the size of the indicator. Therefore, when a plurality of types of game machines are mass-produced, an attempt is made to achieve commonality of components by using identical indicators, thereby curtailing costs of component parts and enabling provision of low-cost game machines. However, the indicator provided in such the game machine displays contents unique to the game machine. Hence, there is a necessity of recording display content information about contents, which vary according to the kinds of game machines, into a recording medium such as a ROM (i.e., Read Only Memory) etc. Hence, an operation for recording display content information into the ROM varies according to the kind of game machine, thereby hindering an attempt to achieve commonality of operations during manufacturing processes.

SUMMARY OF THE INVENTION

The present invention has been conceived in light of the aforementioned drawbacks, and an object of the present invention is to provide a display device which enables users, such as players, operators, etc., to change contents to be provided and realization of commonality of operations during processes for manufacturing a game machine, and to provide a game machine equipped with the display device.

To achieve the object, according to a first aspect of the present invention, there is provided a display device for use in a game machine which includes a variable display device for variably displaying a plurality of symbols and provides a bonus to a player when a predetermined winning combination of symbols is achieved along any one of winning lines of the variable display device when variable displays of the variable display device are stopped. The display device comprises an indicator, a recording medium having recorded therein a plurality of display content information items which can be displayed on the indicator, a display content selector which selects display contents to be displayed on the indicator by manual operation, and a display control device, which reads out, from the recording medium, display content information corresponding to the display content selected by the display content selector, and which displays the display contents on the indicator on the basis of the display content information.

In the display device, a plurality of display content information items which can be displayed on an indicator are recorded in a recorded medium. An operator, a player, or an assembly worker can actuate a display content selector, thereby enabling selection of display contents to be displayed on the indicator from among the plurality of display content information items. Here, the term "display content (s)" means a content to be displayed on the indicator during the course of a round of game operations and does not mean display contents which are changed in accordance with a game status during the course of game operation. By using the display device in a game machine, the game machine enables changing of display contents from contents related to, for example, baseball, to contents related to, for example, soccer, or to contents unique to a parlor, such as an amusement arcade etc., where game machines are to be installed by the operator of the amusement arcade etc.

When a plurality of types of game machines equipped with identical indicators are manufactured, there are required considerably simple operations, such as an operation of workers selecting a predetermined display content by using a display content selector, during the course of assembly of game machines, so long as display contents pertaining to all game machines are recorded in the recording medium.

According to a second aspect of the present invention, it is preferable that the display content selector is located at a position where a player, who plays a game by using the game machine, can actuate the display content selector.

In the display device, the player of a game machine can actuate the display content selector. Display contents can be changed so as to meet a player's preference. Even in the same game status, the display device can display images which vary according to display contents, by a selecting action of the player. Hence, a player's interest in viewing images of all display contents is increased, thereby prompting the player to play a game on the game machine.

According to a third aspect of the present invention, it is preferable that the display content selector has a user operation prevention device for preventing actuation by a user of the game machine.

Some of contents to be displayed on the display device of the game machine should not be changed by the player without permission. For instance, in a case where display contents serving as a reporting function are set so as not to be displayed, if a player can change settings such that the display contents are displayed without permission, substantially all players can start a bonus game immediately when a winning combination, such as a big bonus (BB) or a regular bonus (RB), has been determined by internal drawing operation. Consequently, a token payout rate which is a predetermined bonus of a game machine is greatly changed, thereby greatly affecting the business operation of a parlor, such as an amusement arcade etc., where the game machines are installed.

Further, some display contents should not be changed by operators or by players without permission. For example, in a case where display content information about game machines of unannounced types is recorded in the recording medium, if the display contents are changed by the players or operators without permission, manufacturers of the game machines will suffer damages.

In the display device according to the present invention, the display content selector is provided with a user operation prevention device for preventing the user of the game machine from actuating the display content selector, thus preventing a player or an operator from changing display contents. When only players are prohibited from actuating the selector, the display contents elector is disposed within a casing of the game machine where the player cannot actuate the selector. Moreover, if operators are also prohibited from actuating the selector, the display content selector is provided within a casing of the display device as the user operation prevention device.

According to a fourth aspect of the present invention, there is provided a game machine which comprises a variable display device which variably displays a plurality of symbols, and has winning lines, a variable display stop device which stops variable display of the variable display device, wherein a bonus is supplied to a player when a predetermined winning combination of symbols is achieved along any one of the winning lines of the variable display device at a time variable displays of the variable display device are stopped, and a display device for providing images with the player. According to the fourth aspect of the invention, it is preferable that the display device includes the display device as defined in the first to third aspects of the present invention.

In this game machine, the display device as defined in the first to third aspects is employed as a display device for providing images to a player. Hence, an operator, a player, or an assembly worker can select display contents from among a plurality of display content information items by way of actuation of the display content selector. The game machine may comprise a display device for providing another information item, such as information about the number of games having been played since the previous bonus game. Such an information item may be reported to a player by using the display device.

According to a fifth aspect of the present invention, it is preferable that the variable display stop device is to be actuated by a player.

In the game machine, the variable display stop device is actuated by a player. A game machine having such a configuration is a slot machine. According to the present invention, an operator, a player, or an assembly worker can change the display contents of the display device provided in such a slot machine by using a display content selector.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

There now will be described an embodiment in which the present invention is applied to a slot machine, which is one type of game machine. Slot machines according to the present embodiment may be installed in a "Pachinko" parlor.

The configuration of a slot machine 1 according to the present embodiment now will be described.

Figure 1:
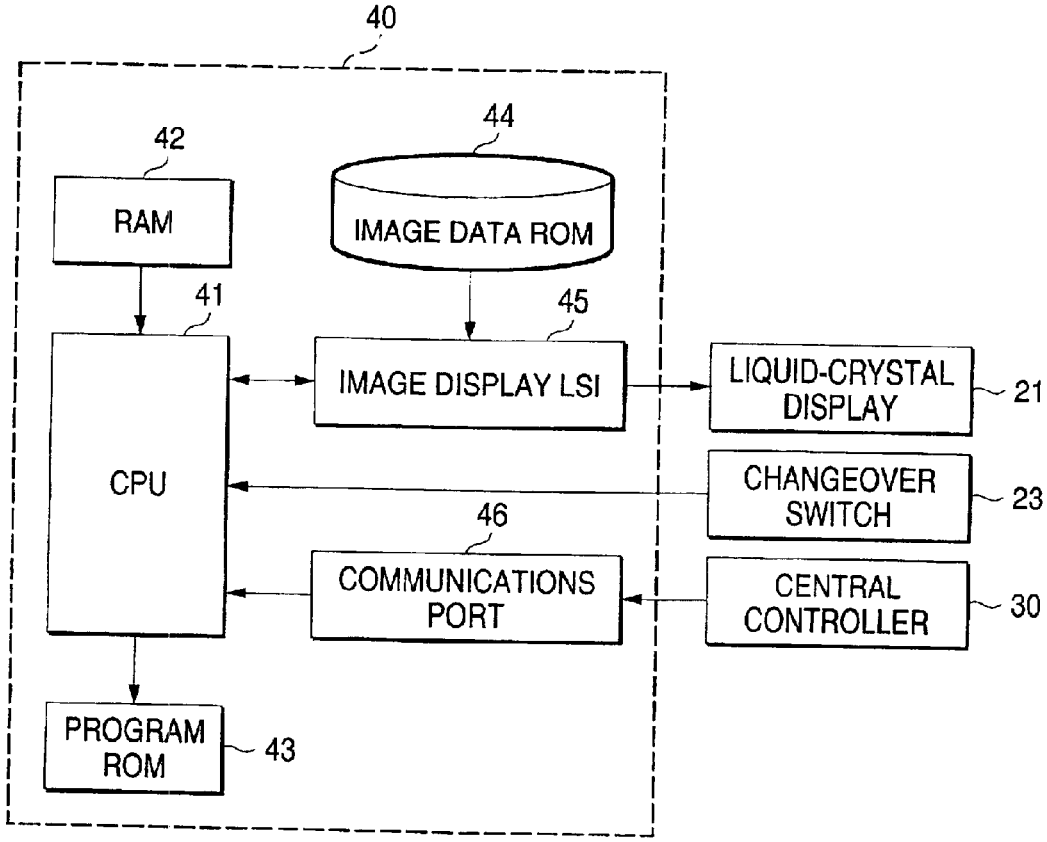
FIG. 1 is a block diagram showing the configuration of a liquid-crystal display unit of a slot machine according to the present invention.
Figure 2:
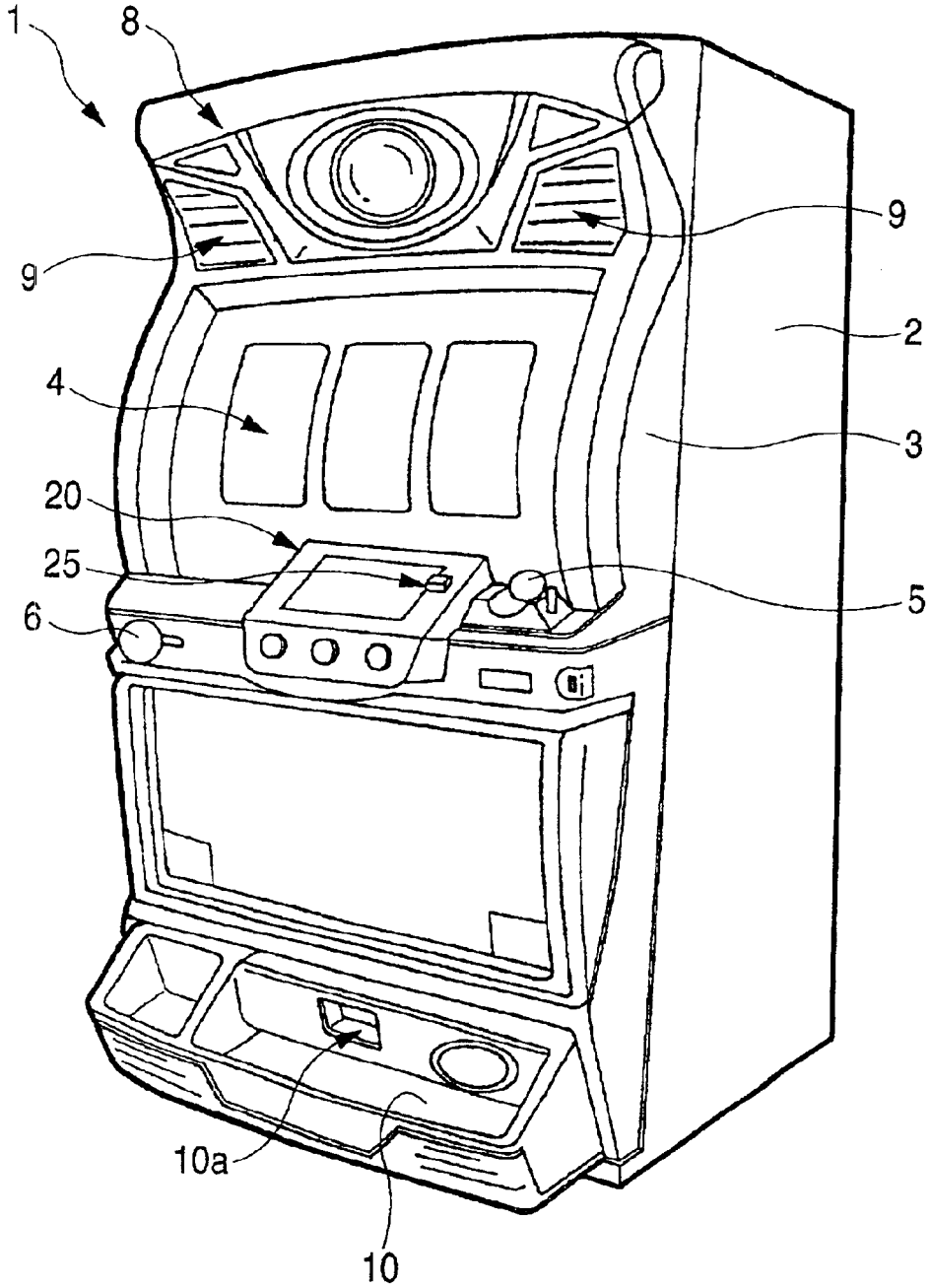
FIG. 2 is an external view of the slot machine.

FIG. 2 is an external view of the slot machine 1 according to the present embodiment. The slot machine 1 has a box-shaped cabinet 2 and a front panel 3 removably attached to a front side of the cabinet 2. Three display windows 4 and a token insertion slot 5 are provided on the front panel 3. The display windows 4 are respectively assigned to three reels included in a variable display device. Each of the display windows 4 shows three symbols provided on one reel. A token identification device (not shown) linked to the token insertion slot 5 is provided behind the front panel 3. The token identification device identifies the number of inserted tokens and determines whether or not the inserted tokens are valid or anomalous. A start lever 6 serving as a variable display start device and stop buttons 7*a*, 7*b*, and 7*c*—which are provided so as to correspond to the respective reels and serve as a variable display stop device—are provided on the front panel 3 as elements to be actuated by a player. Further, component parts provided on the front panel 3 are lamps 8 and loudspeakers 9 for effecting various presentations, a token receiver 10 having a token payout port 10*a*, and a liquid-crystal display 21 (see FIG. 1) which serves as an indicator used as the display device.

Figure 3:
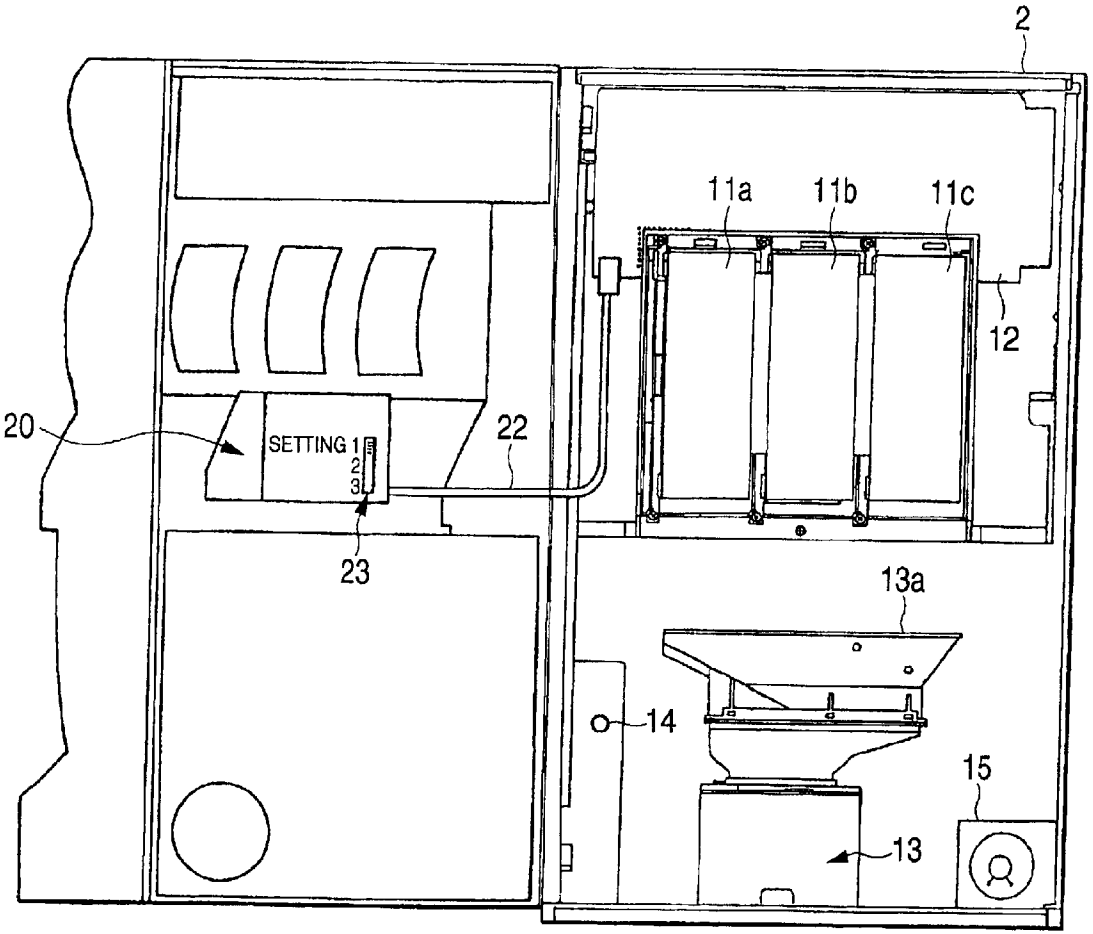
FIG. 3 is a schematic block diagram showing the internal structure of the slot machine.

FIG. 3 is a schematic block diagram showing the slot machine 1 having the front panel 3, which has been opened. The cabinet 2 houses three reels 11*a*, 11*b*, and 11*c* having a plurality of symbols printed thereon; a central control board 12 on which various types of electronic components, such as a CPU (i.e., Central Processing Unit), ROMs, etc., are disposed to form electronic circuits; a token payout device 13 having a token hopper 13*a* capable of holding a plurality of tokens; an error recovery switch 14; and an internal loudspeaker 15.

Component parts provided behind the front panel are the liquid-crystal display 21 and a liquid-crystal display unit 20 having a display control board (not shown) for controlling contents to be displayed on the liquid-crystal display 21. The display control board provided in the liquid-crystal display 20 is connected to the central control board 12 by way of a cable 22. Further, the liquid-crystal display unit 20 has a changeover switch 23 serving as a display contents selector for selecting contents to be displayed on the liquid-crystal display 21.

Playing procedures of a player who uses the slot machine 1 and operation of the slot machine 1 now will be described.

When a player inserts a token into the token insertion slot 5, the token is guided to the token identification device. When having been identified as valid in light of predetermined requirements, the token is taken as an effective token by the token identification device. The token is then sent to a token counter (not shown) provided inside the slot machine 1. The token that has been counted by the token counter is delivered to the token hopper 13*a*. In contrast, when having been identified as anomalous, the token is not counted by the token counter and is returned to the player by way of the token payout port 10*a*.

When the effective token has been counted, the game can be started. When commencing a game, the player pushes down the start lever 6. By way of lowering action, a reel drive unit (not shown) having a stepping motor starts rotating the three reels 11*a*, 11*b*, and 11*c*. When the player presses the stop buttons 7*a*, 7*b*, and 7*c*, the corresponding reels 11*a*, 11*b*, and 11*c* come to a stop. When all the reels 11*a*, 11*b*, and 11*c* are stopped, symbols printed on the reels come to a stop for display along winning lines painted on the display windows 4. When an effective combination of symbols, that is a predetermined winning combination, is achieved along any one of the winning lines, the token payout device 13 pays out a predetermined number of tokens in accordance with the kind of the thus-aligned symbols. As a result thereof, replay of the game becomes possible without involvement of insertion of an additional token, or a bonus game, which is a special game status, becomes available. In contrast, when no effective combination of symbols is achieved, no token is paid out, and no game bonus is available.

There now will be described the configuration and operation of a central controller which controls individual sections and processing operations of the slot machine 1.

Figure 4:
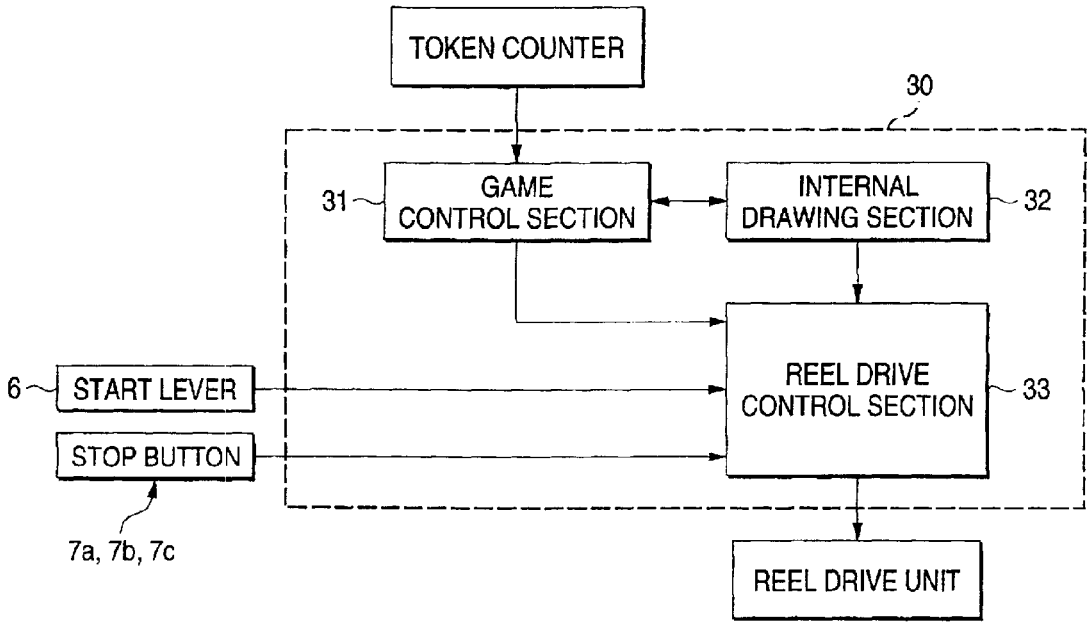
FIG. 4 is a functional block diagram showing the function of a central controller of the slot machine.

FIG. 4 is a functional block diagram showing the function of a central controller 30 which is equipped with a microcomputer having a CPU, a ROM, a RAM (i.e., Random Access Memory), and various interfaces. The illustrated functions are implemented by the CPU executing a computer program recorded in the ROM. The computer program recorded in an external recording medium may be loaded into the RAM, after which the thus-loaded program may be executed by the CPU.

The central controller 30 has three functions, which are carried out by a game control section 31, an internal drawing section 32, and a reel drive control section 33, respectively. In response to a predetermined request output from the token counter, the game control section 31 controls progress of an overall game. The internal drawing section 32 serves as a winning combination selection device for selecting an arbitrary one from a plurality of types of effective combinations. The reel drive control section 33 acts as a stop control device for controlling spinning operations of the reels 11*a*, 11*b*, and 11*c* on the basis of a result of drawing operation.

Figure 5:
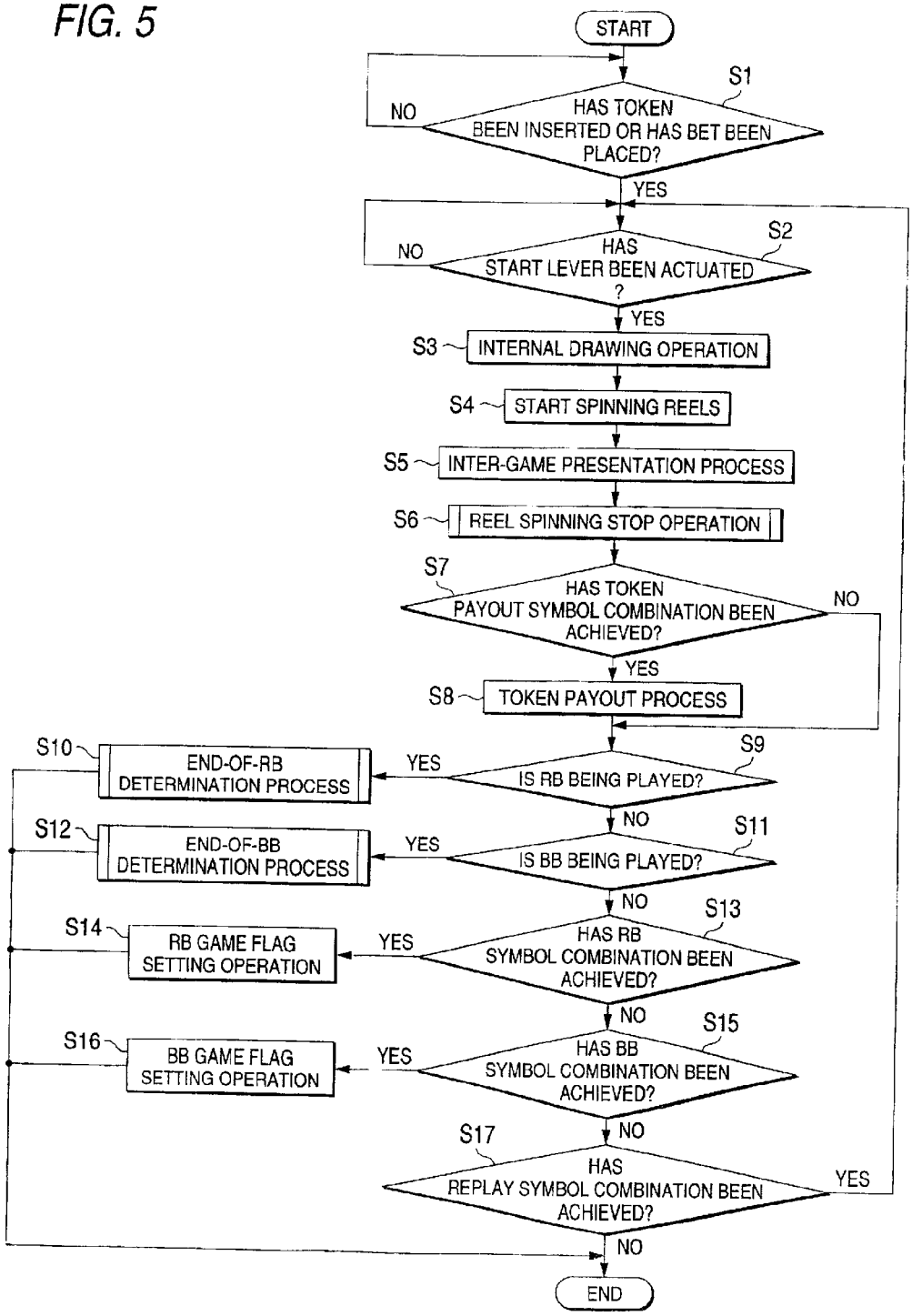
FIG. 5 is a flowchart showing flow of progress in a game of the slot machine.

FIG. 5 is a flowchart showing the flow of progress in the game performed by the game control section 31. On the basis of a signal output from the token counter, a determination is made as to whether a token has been inserted into the token insertion slot 5 or there still remains a bet recorded in a predetermined RAM (see S1). When the player actuates the start lever 6 (see S2), a game start signal is output to the internal drawing section 32, thereby effecting internal drawing operation (see S3).

Upon receipt of the game start signal output from the game control section 31, the internal drawing section 32 generates random numbers for drawing purpose with the internal drawing operation. With reference to a winning probability table having described thereon effective combinations and occurrence probabilities thereof, the internal drawing section 32 determines a winning combination on the basis of the thus-generated drawing random numbers. Effective combinations, which have been prepared beforehand, include a replay enabling combination, which enables replay of a game and corresponds to an ordinary winning combination; small effective combinations, which are represented by symbols, such as "Cherry", "Watermelon", "Bell", etc., enable payout of tokens, and correspond to ordinary winning combinations; and bonus effective combinations, which enable the player to play a big bonus (BB) game or a regular bonus (RB) game and correspond to special winning combinations. There may be a case where a failure is determined instead of an effective combination of symbols with the internal drawing operation of the internal drawing section 32. With the internal drawing operation, a winning flag is set to a winning combination that has been hit. The result of drawing operation is delivered to the reel drive control section 33.

When the player has actuated the start lever 6, the game control section 31 outputs a game start signal to the reel drive control section 33. The reel drive control section 33 controls the reel drive unit, thereby starting spinning of all the reels 11*a*, 11*b*, and 11*c* (see S4). The game control section 31 controls the lamp 8 and the loudspeaker 9, thereby providing various presentations (see S5). When all the reels 11*a*, 11*b*, and 11*c* have reached a predetermined number of rotations, actuation of the stop buttons 7*a*, 7*b*, and 7*c* becomes effective. When the player actuates the stop buttons 7*a*, 7*b*, and 7*c*, the reels 11*a*, 11*b*, and 11*c* corresponding to the thus-actuated stop buttons are stopped (see S6).

Figure 6:
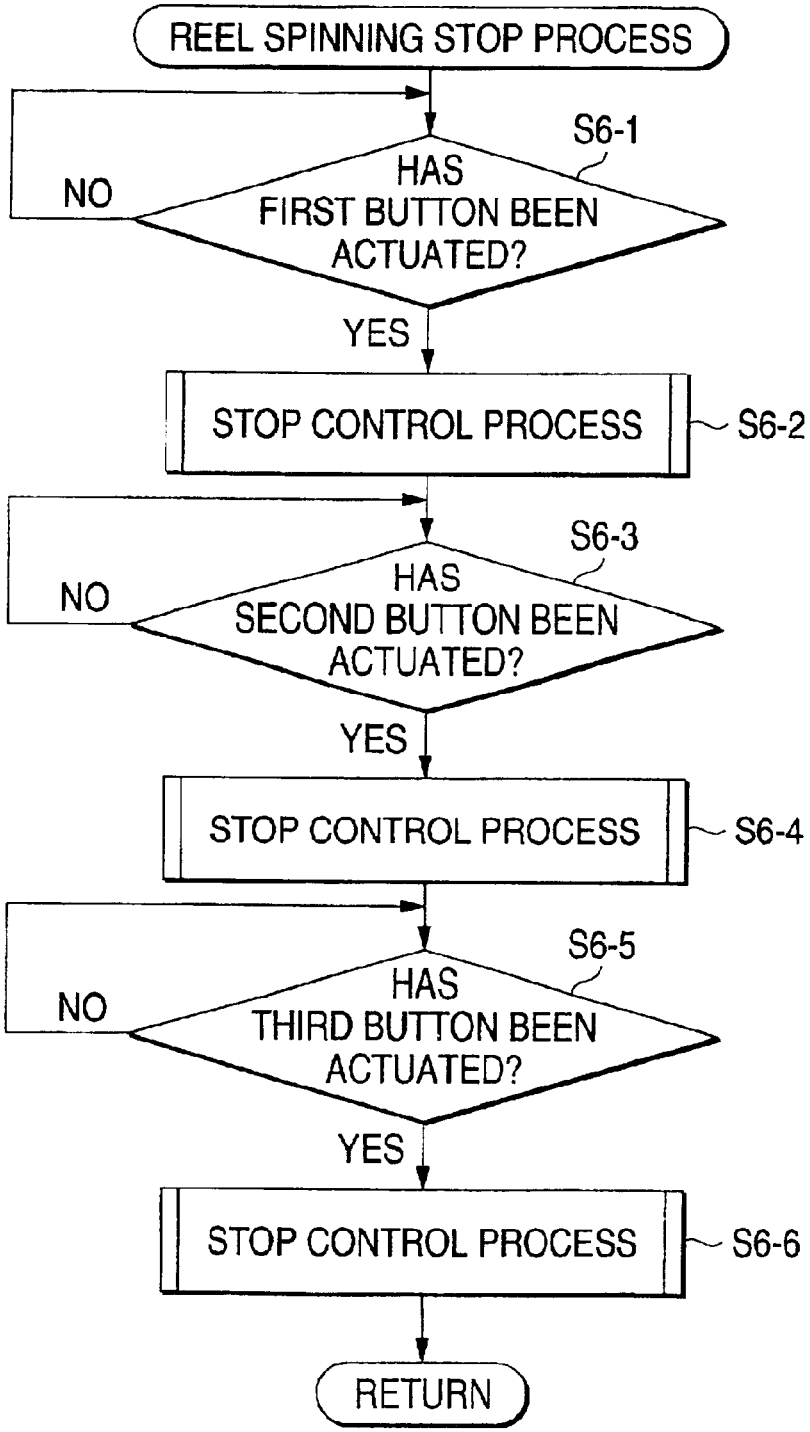
FIG. 6 is a flowchart showing a reel spinning stop operation to be performed by a reel drive control section of the slot machine.

FIG. 6 is a flowchart showing an operation of the reel drive control section 33 for stopping spinning of the reels. In accordance with the player's first actuation of a button, the reel drive control section 33 receives a stop signal from the stop button 11*a* located on the left as viewed by the player (see S6-1) On the basis of a result of drawing operation output from the internal drawing section 32, the reel drive control section 33 controls the reel drive unit and performs a stop control operation for stopping the reel 7*a* corresponding to the stop button 11*a* (see S6-2). If a symbol of "Watermelon" serving as a small effective combination has been selected by the internal drawing section 32, spinning of the reel 7*a* is controlled to stop such that symbols of "Watermelon" are aligned along a predetermined winning line, by way of the stop control operation. If the symbol of "Watermelon" is present within a range of about four symbols when the stop button is actuated, the symbol of "Watermelon" is controlled so as to stop along the winning line. If no symbol of "Watermelon" is present within a range of four symbols when the stop button is actuated, the stop control operation is not performed even if a combination of the symbols of "Watermelon" has been selected as an effective combination of symbols. Hence, the symbol of "Watermelon" does not come to stop at the winning line.

Similarly, when the player actuates the second and third buttons, the stop button 11*b* located at the center and the stop button 11*c* located at the right-hand end as viewed by the player output stop signals to the reel drive control section 33 (see S6-3 and S6-5), thereby stopping the reels 7*b* and 7*c* corresponding to the stop buttons 11*b* and 11*c* (see S6-4 and S6-6).

The description is made with regard to a case where the player has actuated the stop buttons 11*a*, 11*b*, and 11*c* sequentially from the left as viewed by the player. The sequence of pressing the stop buttons is not limited to such an example. The stop buttons may be pressed randomly; e.g., the center stop button 11*a* is pressed first.

Turning again to FIG. 5, when the reels 7*a*, 7*b*, and 7*c* are stopped in this way, there are performed processing routines corresponding to an effective combination of symbols determined in light of the symbols aligned along one of the winning lines (see S7, S13, S15, and S17). When a combination of symbols aligned along one of the winning lines corresponds to a token payout combination (see S7), tokens corresponding to the effective combination are paid out (see S8). When payout of the tokens has been completed, a flag pertaining to the effective combination is cleared. In contrast, if the combination of symbols is determined so as not to be a token payout symbol, tokens are not paid out, and the processing routine proceeds to the next step.

In a case in which the combination of symbols aligned along one of the winning lines corresponds to an RB effective combination (see S13), there is performed a flag setting operation for setting an RB play flag (see S14). By way of the flag setting operation, there are performed presentation showing that an RB game has been hit and display of an image on the liquid-crystal display 21. While the RB play flag is set, the player can play eight JAC games in maximum. The internal drawing section 32 uses a winning probability table for JAC games. In the embodiment, there is employed a winning probability table for JAC games, in which a replay enabling combination is hit substantially without fail. Replay symbols employed in a JAC game are employed as token payout symbols which enable payout of a predetermined number of tokens.

When the combination of symbols aligned along any one of the winning lines corresponds to a BB effective combination (see S15), there is performed a flag setting operation for setting a BB game flag (see S16). With the flag setting operation, there is performed the same operation as that performed during the RB effective combination. In the BB game, the player is granted a right to play the same game as the RB game three times (hereinafter called a "JAC bonus game"). The internal drawing section 32 uses a winning probability table, in which the probability of winning of a replay enabling combination serving as a JAC bonus game entry symbol is set so as to become higher than the probabilities of winning of other effective combinations. When the JAC bonus game entry symbols are aligned during the BB game, the player can play a JAC bonus game. When having finished playing the JAC bonus game, the player can continuously play the BB game again.

When the combination of symbols aligned along at least one of the winning lines corresponds to a replay symbol (see S17), the tokens that had been used for commencing the current game can be transferred to the next game. Hence, in the next game the player can commence a game by actuation of the start lever 6 without use of a token (see S2).

When a BB symbol combination or an RB symbol combination is not formed along any of the winning lines in spite of an RB or BB bonus effective combination having been selected with the internal drawing operation, the winning flag for a bonus effective combination is transferred to the next and subsequent games. Hence, even in the next and subsequent games, the player can achieve a BB symbol combination or an RB symbol combination along any one of the winning lines. When no symbol combination has been achieved in connection with a effective combination flag other than a bonus effective combination, the winning flag is not transferred to the next and subsequent games.

There now will be described a bonus game to be played after an RB game flag or a BB game flag has been set in step S14 or S16.

As in the case of a general play status, a game is commenced by using a token even in a bonus game (see S1 and S2). After internal drawing operation has been performed (see S3), the reels are spun (see S4). There are then performed an inter-game presentation operation (see S5), a reel stop operation (see S6), and, if necessary, token payout operations (see S7 or S8). After the token payout operation has been performed, a determination is made as to whether or not the RB or BB game is being played (see S9 or S1). When the RB play flag or the BB play flag has been set, it is determined that the RB game or BB game is being played. Then, end-of-RB determination processing routines or end-of-BB determination processing routines are performed (see S10 or S12).

Figure 7:
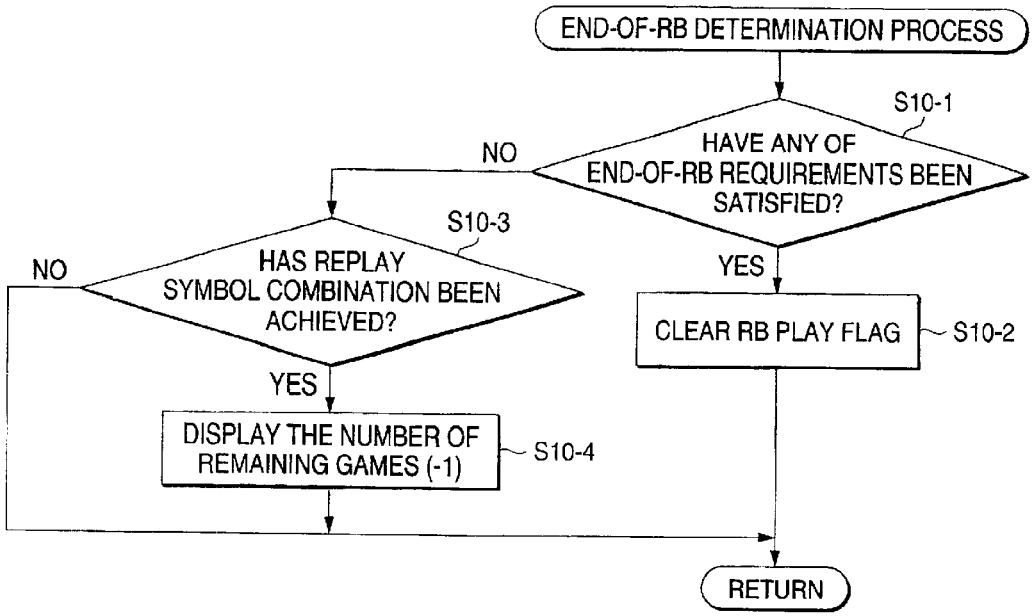
FIG. 7 is a flowchart showing flow of end-of-RB determination processing routines to be performed by the slot machine.
Figure 8:
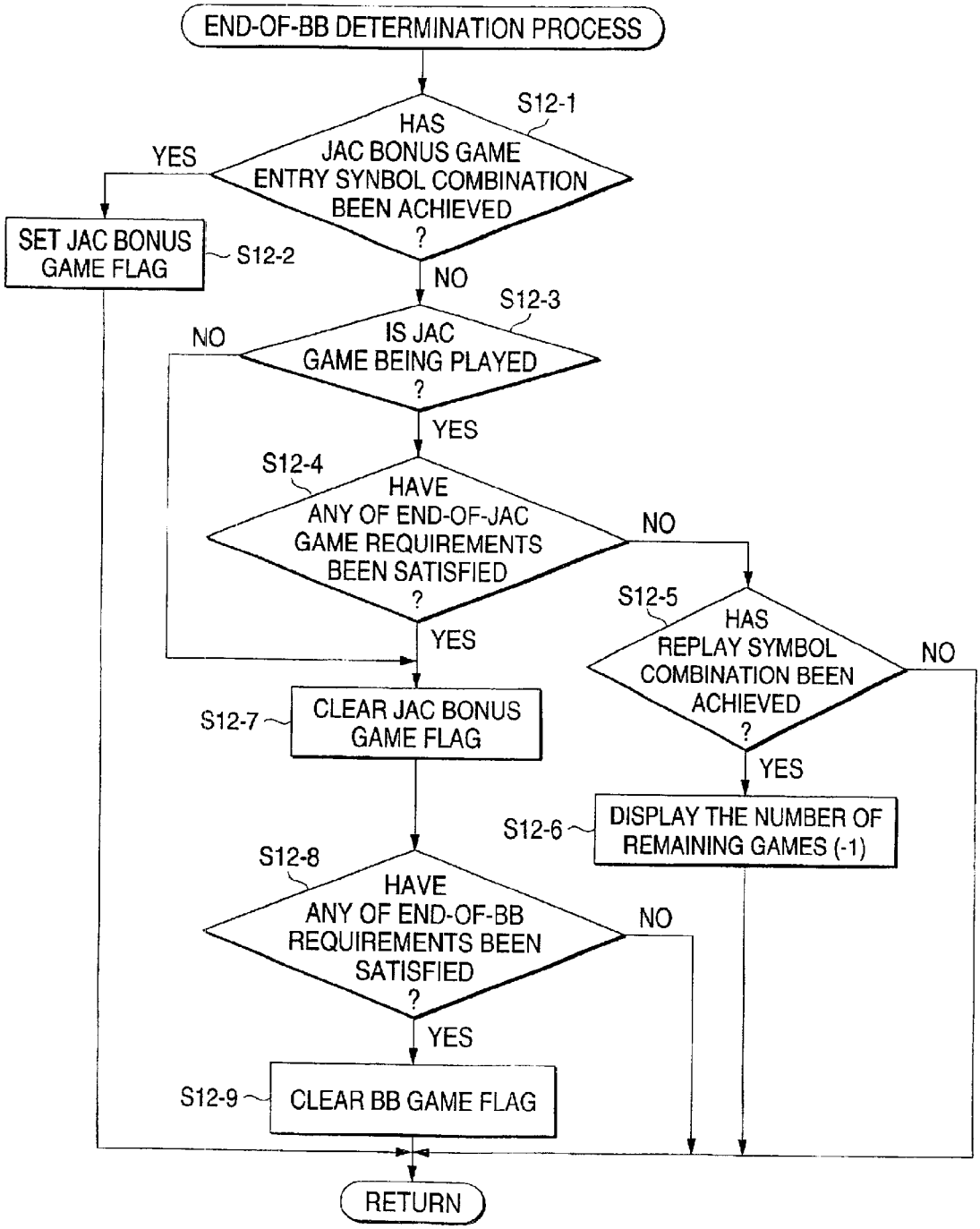
FIG. 8 is a flowchart showing flow of end-of-BB determination processing routines to be performed by the slot machine.

FIG. 7 is a flowchart showing the flow of end-of-RB determination processing routines, and FIG. 8 is a flowchart showing the flow of end-of-BB determination processing routines.

In the end-of-RB determination processing routines, after the number of JAC games performed in the RB game has been counted as only one, a determination is made as to whether replay symbols-which belong to a token payout symbol-have been aligned eight times or a JAC game has been performed twelve times (see S10-1) If it is determined that neither of the end requirement has yet been satisfied, a determination is made as to whether or not a replay symbol combination is formed along any one of the winning lines in the current game (see S10-3). When the replay symbols have been aligned, the number of games determined by subtracting one from the number of games displayed on the liquid-crystal display 21 is displayed (see S10-4). In the next game, a JAC game proceeds again. When replay symbols have not yet been aligned, a JAC game is played again in the next game. If in S10-1 it is determined that any of the end requirements have been satisfied, the RB game flag is cleared (see S10-2). As a result, the game status returns to an ordinary game status from the next game.

In the end-of-BB determination processing routines, after the number of games performed during the BB game has been counted as only one, a determination is made as to whether JAC bonus game entry symbols (i.e., replay symbols) have been aligned along any one of the winning lines in the current game (see S12-1), as shown in FIG. 8. When an aligned symbol combination is a JAC bonus entry symbol, there is performed flag setting operation for setting a JAC bonus flag (see S12-2). In contrast, when the aligned symbol combination is not a JAC bonus game entry symbol, a determination is made as to whether or not a JAC bonus game is being played, on the basis of the JAC bonus flag (see S12-3). When it is determined that a JAC bonus game is being played, a determination is made as to whether or not end-of-JAC bonus game requirements identical with the end-of-RB requirements shown in FIG. 7 have been satisfied (see S12-4). When it is determined that none of the requirements have yet been satisfied, there is performed the same operation as that performed in the RB game shown in FIG. 7 (see S12-5 or S12-6). In contrast, when it is determined that any of the end-of-JAC bonus game requirements have been satisfied, the JAC bonus game flag is cleared (see S12-7).

When in S12-3 it is determined that JAC game is not being played, or when the JAC bonus game flag is cleared as a result of the end-of-JAC bonus game requirements being determined to have been satisfied in step S12-4, a determination is made as to whether or not the end-of-BB requirements have been satisfied (see S12-8). The end-of-BB requirements are for determining whether the JAC bonus game has finished being played three times or the BB game has been played 30 times. Here, if it is determined that none of the end-of-BB requirements have yet been satisfied, there is performed a display processing routine for displaying the number of games determined by subtracting one from the number of JAC bonus games displayed on a number-of-remaining-games indicator 18, when in step S12-4 it is determined that any the end-of-JAC bonus game requirements has been satisfied. When in S12-8 it is determined that any of the end-of-BB requirements has been satisfied, the BB play flag is cleared (see S12-9). As a result thereof, the game status again returns to the ordinary game status from the next game.

Next, the configuration and operation of the liquid-crystal display unit according to the present invention now will be described.

FIG. 1 is a block diagram showing the configuration of the liquid-crystal display unit 20. The liquid-crystal display unit 20 has the liquid-crystal display 21, the changeover switch 23, and a display controller 40 for controlling contents to be displayed on the liquid-crystal display 21. The display controller 40 includes a CPU 41, a RAM 42, and a program ROM 43 having recorded therein computer programs. The CPU 41 controls the contents to be displayed on the liquid-crystal display 21, by way of executing the computer program recorded in the program ROM 43.

The display controller 40 is provided with an image data ROM 44 and an image display LSI (i.e., Large-Scale Integration) 45. The image data ROM 44 acts as a recording medium having recorded therein a plurality of image data sets which serve as display contents information to be displayed on the liquid-crystal display 21. Further, in accordance with an instruction output from the CPU 41, the image display LSI 45 controls the contents to be displayed on the liquid-crystal display 21. In the embodiment, a video pertaining to a professional baseball program is displayed on the liquid-crystal display 21 in accordance with a game status, thereby offering entertainment to the player. Data recorded in the image data ROM 44 are initial image data which are initially set on the slot machine 1 and employ professional baseball team's characters; a plurality of other professional baseball teams' image data using characters of other professional baseball teams; image data unique for the "Pachinko" parlor where the slot machine 1 is to be installed; and image data for use with slot machines differing in type from the slot machine 1. The image display LSI 45 reads out image data corresponding to the instruction output from the CPU 41 from the image data ROM 44. On the basis of the image data, the image display LSI 45 controls contents to be displayed on the liquid-crystal display 21 in accordance with the instruction output from the CPU 41.

The display controller 40 includes a communications port 46 which polls the game status of the slot machine 1 and sends the results of polling to the central controller 30. A CPU 41 always monitors the central controller 30 during the course of a predetermined image display program being executed, for displaying an image corresponding to the game status of the slot machine 1 on the liquid-crystal display 21. Upon receipt of various communications commands from the central controller 30, the CPU 41, which executes the image display program, controls the image display LSI 45 such that image data corresponding to a received communications command are displayed on the liquid-crystal display 21.

Not all the component parts of the display controller 40 need to be disposed within a casing of the liquid-crystal display unit 20. For instance, only an image display LSI and an image data ROM are disposed within the casing, and the remaining component parts are disposed at a location differing from the liquid-crystal display unit 20.

As shown in FIG. 3, in the embodiment, actuation of the changeover switch 23 results in effecting switching between "Setting 1" for displaying initial image data or image data pertaining to other professional baseball players, "Setting 2" for displaying image data unique to a parlor, and "Setting 3" for displaying image data for use with other types of machines. Since the changeover switch 23 is located within the slot machine 1, the player is prohibited from actuating the changeover switch 23.

As shown in FIG. 2, a display changeover button 25 serving as display content selector to be actuated by the player is provided in the exposed portion of the liquid-crystal display unit 20 on the front panel 3 of the slot machine 1. When the changeover switch 23 is set to "Setting 1", the display changeover button 25 changes display contents from initial image data using professional baseball team's characters to image data pertaining to characters of another professional baseball team every time the button is pressed. By way of actuating the display changeover button 25, the player can change contents to be displayed on the liquid-crystal display 21 so as to meet the player's preference. When the changeover switch 23 is set to "Setting 2", the display changeover button 25 is inoperative, so that the player cannot change display contents.

Figure 9:
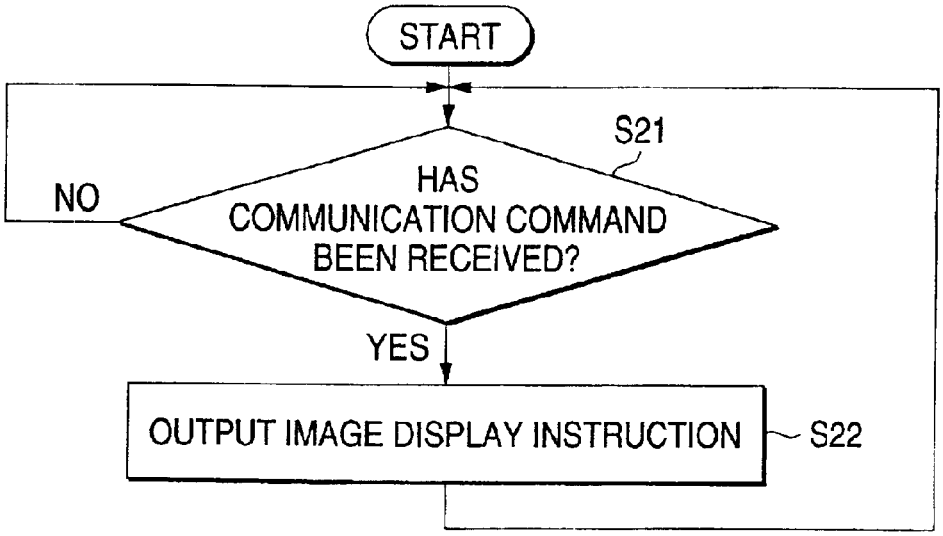
FIG. 9 is a flowchart showing the flow of an image display program to be executed by a display controller of the slot machine.

FIG. 9 is a flowchart showing the flow of an image display program to be executed by the display controller 40.

The CPU 41 executing the image display program remains in a standby condition in which the CPU 41 can receive a communications command from the central controller 30 (see S21). The central controller 30 outputs a communication command; for example, when a BB or RB symbol combination is achieved during an ordinary game status, when a game status has changed as in the case of a BB or RB being selected with internal drawing, or when an idle time during which the player does not play a game has continued for a long period of time. Upon receipt of the communication command by way of the communications port 46, the CPU 41 outputs to the image display LSI 45 an image display instruction corresponding to the communication command (see S22). The image display LSI 45 that has received the image display instruction uses image data that have been selected by using a display content changeover program (described later). From the image data, there are read image data corresponding to the image display instruction, and the thus-read image data are displayed on the liquid-crystal display 21.

Figure 10:
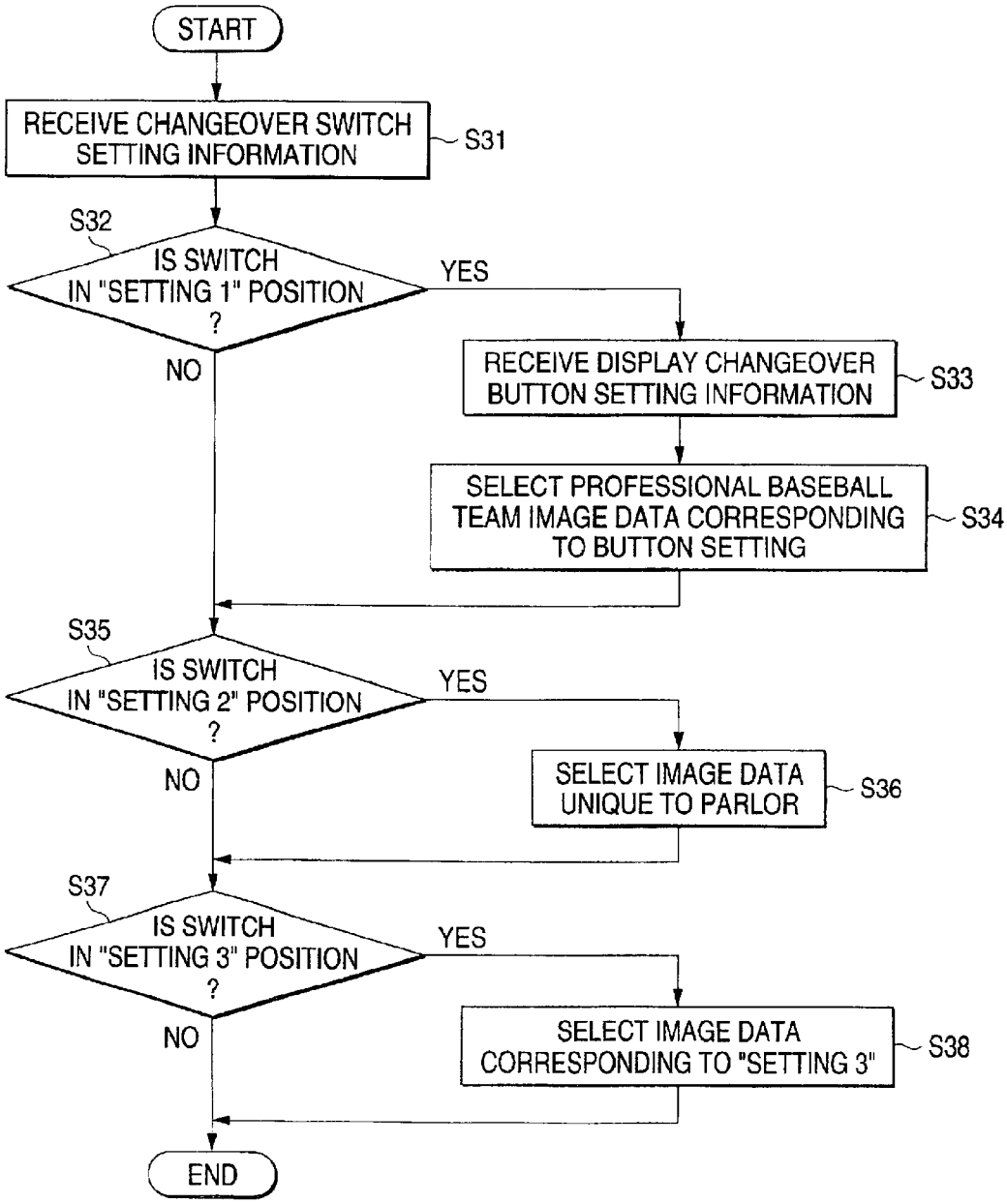
FIG. 10 is a flowchart showing the flow of a display content changeover program to be executed by the display controller.

FIG. 10 is a flowchart showing the flow of a display content changeover program to be executed when display contents have been changed by way of the changeover switch 23 or the display changeover switch 25.

The CPU 41 which executes the display content changeover program receives a setting information signal output from the changeover switch 23 when the changeover switch 23 or the display changeover switch 25 is actuated (see S31). When the changeover switch 23 is set to "Setting 1" (see S32), the setting information signal output from the display changeover button 25 is received (see S33). The CPU 42 that has received the setting information signal selects professional baseball image data corresponding to the setting information signal (see S34). The information is delivered to the image display LSI 45, where a display processing routine based on the image display program shown in FIG. 9 is performed by using the selected professional baseball image data. When the changeover switch 23 is set to "Setting 2" (see S35), image data unique to the parlor recorded in the image data ROM 44 are selected (see S36). The image display program using the unique image data is executed. Even when the changeover switch 23 is set to "Setting 3" (see S37), image data corresponding to the setting are selected (see S38), and there is executed an image display program using the image data.

Figure 11:
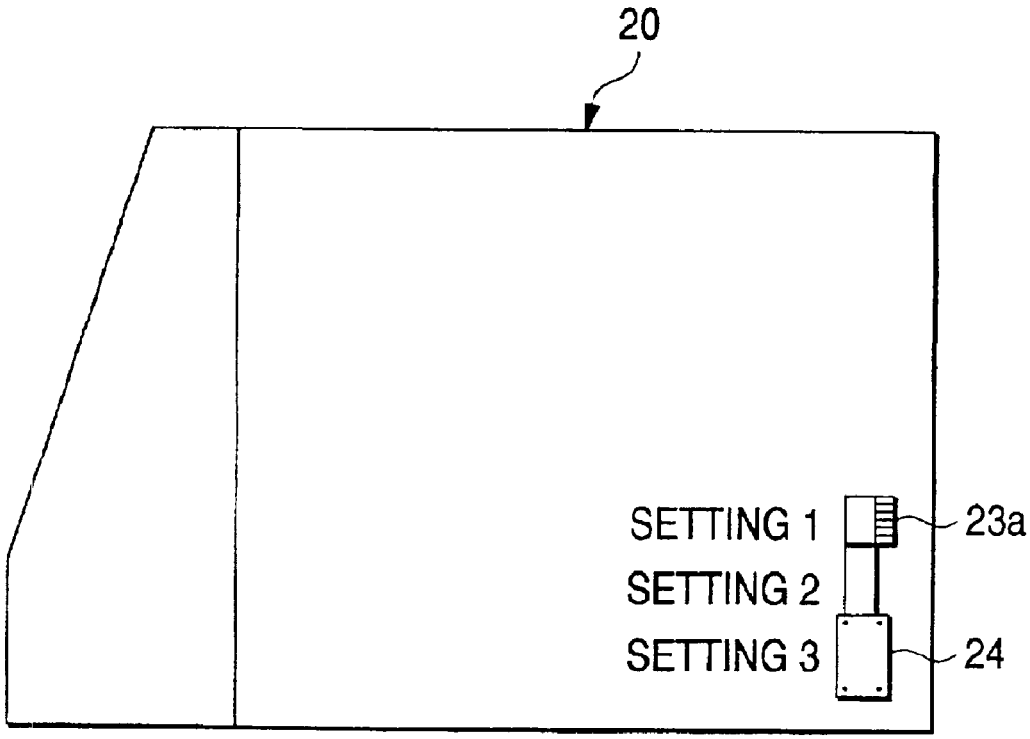
FIG. 11 is an enlarged view showing a changeover switch provided in the liquid-crystal display unit of the slot machine.

Here, the slot machine 1 does not use "Setting 3" for displaying the image data for use with other types of machines. However, so long as the image data for use with other types of machines are prepared beforehand, the only requirement for assembly workers is to change the changeover switch 23 to "Setting 3" at the time of assembly of the liquid-crystal machine 20 into another type of slot machine, thereby obviating a necessity of rewriting image data. In a case where image data for use with another type of machine, the data being to be displayed in "Setting 3", are for use with an unannounced type of machine, a slot machine manufacturer may suffer damages as a result of players or operators of parlors displaying the image data without permission. In order to prevent occurrence of such a problem, as shown in FIG. 11, there may be provided a plate 24 serving as a user actuation prevention member in "Setting 3" to prohibit actuation of a knob 23*a* of the changeover switch 23 to "Setting 3". Alternatively, there may be adopted an arrangement whereby actuation of the knob 23*a* to "Setting 3" requires use of a key owned by the manufacturer.

An operator of a "Pachinko" parlor can select display contents of "Setting 1" or display contents of "Setting 2" by way of actuation of the changeover switch 23. The changeover switch 23 is usually set to"Setting 1". However, for example, when a "Pachinko" parlor is newly opened or early-morning service is provided, the operator sets the changeover switch 23 to "Setting 2". Display contents based on the image data unique to the parlor are displayed on the liquid-crystal display 21, thereby advertising the parlor.

The embodiment has been described in connection with a case where the changeover switch 23 and the display changeover switch 25, which serve as a display content changeover switch, are provided on the liquid-crystal display unit 20. In this case, a setting information signal output from the changeover switch 23 or the display changeover switch 25 may be delivered to a display controller 40 of the liquid-crystal display unit 20 by way of the central controller 30. Such a construction enables the central controller 30 to use a setting information signal. Hence, switching between display contents based on the setting information signal may be limited to predetermined conditions, or setting information may be utilized for progress in a game.

Although the embodiment has described a slot machine to be installed in a "Pachinko" parlor, the present invention can be applied also to a slot machine to be installed in any other places, such as an amusement arcade etc. Moreover, the present invention can be applied not only to a slot machine, but also to game machines of any types, such as a "Pachinko" machine which is equipped with a variable display device, such as a liquid-crystal screen, and enables a player to play under a special game status when a specific symbol combination is achieved on the liquid-crystal screen.

According to the present invention, a user, such as a player or an operator of a parlor, can change display contents to be provided to a player. Hence, there is yielded an advantage of an increase in the degree of freedom of change in display contents for the user.

So long as display contents pertaining to various game machines are recorded in a recording medium, the only requirement for assembly workers is to actuate a display content selector during the course of assembly of each game machine, thereby accomplishing commonality of work.

According to the present invention, there is yielded an advantage of ability to display contents so as to meet the player's preference.

According to the present invention, there is yielded an advantage of ability to prevent users of game machines from changing display contents without permission, thereby protecting the interests of manufacturers of game machines.

Although the above-described embodiment employs game machines utilizing tokens as one example, it should be noted that the game machines, to which the present invention is applicable, are not limited to game machines utilizing tokens. Namely, the present invention is applicable to any game machines that utilize a payment object used as compensation which is necessary for players to play (or commence) the games. For example, the payment object includes money, such as a coin, a paper currency, a bank note, a bank bill, etc., and other objects, such as a token, a medal, etc.

It is contemplated that numerous modifications may be made to the display device, and the game machine equipped with the display device, of the present invention without departing from the spirit and scope of the invention as defined in the following claims.

What is claimed is:

1. A game machine, comprising:

a main body;

a display device, operable to display a plurality kinds of images including a first game image;

a first switch, provided on an outer face of the main body; and a second switch, disposed within the main body to select one of a plurality modes including:

a first mode, in which at least one of a plurality kinds of first images, which are selectable by the first switch, is displayed in the display device; and a second mode, in which at least one kind of second image which is not controllable by the first switch is displayed in the display device.

2. The game machine as set forth in claim 1, wherein the modes includes a third mode in which a second game image is displayed in the display device instead of the first game image.

* * * * *